US008119893B2

(12) United States Patent
Dunwoodie

(10) Patent No.: US 8,119,893 B2
(45) Date of Patent: Feb. 21, 2012

(54) MAGNETIC BRIDGES AND TAILPIECES FOR STRINGED INSTRUMENTS

(76) Inventor: David Andrew Dunwoodie, Delta (CA)

( * ) Notice: Subject to any disclaimer, the term of this patent is extended or adjusted under 35 U.S.C. 154(b) by 274 days.

(21) Appl. No.: 12/407,768

(22) Filed: Mar. 19, 2009

(65) Prior Publication Data

US 2010/0236375 A1 Sep. 23, 2010

(51) Int. Cl.
*G10D 3/00* (2006.01)

(52) U.S. Cl. ..... 84/312 R; 84/313

(58) Field of Classification Search ..... 84/312 R, 84/313, 297 R, 298–302
See application file for complete search history.

(56) References Cited

U.S. PATENT DOCUMENTS 4,457,201 A * 7/1984 Storey ..... 84/313
6,291,758 B1 * 9/2001 Turner ..... 84/726

* cited by examiner

*Primary Examiner* — Kimberly Lockett

(57) ABSTRACT

Improved bridges and tailpieces for stringed instruments, such as guitars and banjos. The bridge and tailpiece each include a void at each end of their respective base pieces, near the vertical hole or slot, into which is fixedly set a permanent magnet. The magnet attracts to the ferromagnetic metal bridge posts or tailpiece posts to retain the bridge or tailpiece on the posts and keep them from falling off when the strings are removed from the instrument.

9 Claims, 1 Drawing Sheet

MAGNETIC BRIDGES AND TAILPIECES FOR STRINGED INSTRUMENTS

BACKGROUND OF THE INVENTION

1. Field of Invention

The present invention relates generally to bridges and tailpieces for stringed instruments, and more particularly to bridges for guitars known as Tune-o-matic style bridges, and tailpieces designed for use therewith, and similar designs, which are typically mounted on adjustable posts or studs that are screwed or mounted into the guitar body.

2. Description of Related Art

Some stringed instruments, such as some electric guitars, use a style of bridge and tailpiece in which each is connected to the instrument's body via two threaded bridge or tailpiece posts (respectively) that are screwed or secured directly into the top of the stringed instrument body. In the case of the bridge, it rests on two knurled nuts or adjustment wheels that allow for the height of the bridge to be adjusted. In the case of the tailpiece, slots at each end of the tailpiece rest within a circumferential groove on the tailpiece posts. This type of bridge is commonly referred to in the industry as a Tune-o-matic bridge. Also, other stringed instruments with arched tops such as mandolins, bouzoukis and hollow-body electric/acoustic guitars with arched tops and backs (such as jazz guitars) use a similar style bridge and tailpiece.

FIG. 1 shows an exemplary top view of a Tune-o-matic style guitar bridge 10 as it would be typically mounted on a guitar body 12, together with a tailpiece 14. The tailpiece 14 holds one end of strings 16 and provides the mechanical strength for the tension of the stretched strings against the body of the guitar. The strings 16 then pass over the bridge 10, and in the case of an electric stringed instrument or guitar, the strings 16 will also pass over one or more pickups and then pass over the neck of the instrument and over a nut to the tuning pegs or machine heads.

Typically, a Tune-o-matic style guitar bridge 10 comprises an elongate base piece or bar 18 that is typically formed of metal, such as steel or brass. A top surface 20 of the bar 18 is generally flat, while the opposite bottom surface is generally concave to match the curvature of a guitar. Cut or formed in the bar 18 are several square or rectangular holes 24 extending from the top surface 20 through the bottom surface. In each of the square or rectangular holes 24 is movably mounted a saddle 26 that supports the strings 16 and that is adjustable longitudinally in relation to the strings by means of an adjustment screw. Vertically through each end of the bar 18 are vertical alignment holes 28 extending from the top surface 20 to the bottom surface. A pair of adjustable metal bridge posts 32 comprising of a partially or completely threaded post member 34 on which is mounted an adjustment wheel 36 having a complementary threaded central hole. The top portion of the post member 34 is sized to fit within vertical alignment holes 28. The most common of Tune-o-matic style bridges use either a 4 mm or 6 mm diameter vertical alignment holes 28. The lower portion of the bridge post 32 is fixedly mounted in the guitar body in a configuration such that the post members 34 align with the two vertical alignment holes 28 in the bar 18. In a conventional Tune-o-matic style bridge the bar 18 rests upon the adjustment wheel 36 such that the post members 34 are received within vertical alignment holes 28. Adjustment wheels 36 on each adjustment post 32 are either raised or lowered to achieve a desired height of the bar 18.

Typically, the tailpiece 14 comprises an elongate base piece 40 that is formed of metal, such as steel or brass. A top

42 and an opposite bottom surfaces of the tailpiece 14 are generally curved in order to aesthetically match the surface curve of a guitar upon which the tailpiece 14 is to be mounted. Several string holes traverse the base piece 40 and are generally evenly spaced apart along the length of the tailpiece 14, are formed or machined through the tailpiece 14. These string holes also have chamfered edges or indentations of a slightly larger diameter on both the front and rear entries of the string holes to accommodate small balls which are manufactured at the ends of steel strings used in some guitars. The strings are placed through the string holes towards the bridge 14 and nut of the instrument, not shown. It is the balls on the ends of the strings which act as stops and absorb the tension on the strings after top ends of the strings are mounted on tuning screws on a neck of the instrument.

Vertical slots 44 are formed on each end of the tailpiece 14. These slots 44 are typically rounded and extend from the top surface 42 through the bottom surface, and accommodate the tailpiece studs or posts 46 upon which the tailpiece 14 is mounted.

Many of these kinds of bridges and tailpieces of the prior art are only held in place by the tension of the strings 16 such that when the strings are removed, the bridge and tailpiece become freely removable. If proper care is not taken, the bridge, tailpiece and other components may fall off the instrument during string replacement and possible mar the instrument body or the components. Furthermore, a complete readjustment of all the components of the stringed instrument is typically required after every loosening and/or removal of strings for simple operations such as cleaning and simple maintenance, thereby necessitating considerable time and effort to return the instrument to a playable condition.

To address some of these problems with the prior art, some manufacturers of Tune-o-matic style bridges added the feature of one or more set-screws on the bridge and tailpiece, located adjacent and perpendicular to the vertical adjustment hole 26 and slot 44 respectively. The setscrew is within a threaded hole on the edge of the bridge or tailpiece, extending from the edge into the vertical adjustment hole 26 or slot 44. The setscrew is tightened against the top portion of the post member 34 in the case of a bridge, and against the tailpiece post 46 in the case of a tailpiece, to secure the respective part onto its post. A problem with the use of a setscrew is that the threads of the setscrew hole can become stripped which would necessitate replacement of the entire bridge or tailpiece. Another problem is that over tightening the setscrew causes damage to the upper portion of the post member 34, which in the case of a post having a threaded upper portion, would destroy the threads thereby limiting the range of movement of the adjustment wheel 36. A further problem is that the setscrew requires the use of another tool, such as a small sized hex key or Allen wrench, which can be lost, causing an inconvenience to the user until a replacement is found. In addition, the vertical alignment holes in the kinds of bridges often have a very slight taper as a result of the manufacturing process and the tightening of a setscrew forces the tapered internal wall of the vertical adjustment hole against the post which imparts a slight tilt to the bridge. Accordingly, there is a need for an improved devices and methods for securing a bridge and tailpiece to a stringed instrument body, such as a guitar body.

SUMMARY OF THE INVENTION

The above shortcomings may be addressed by providing, in accordance with one aspect of the invention, an improved bridge and tailpiece for securing to a stringed instrument, such as a guitar, banjo, and the like. In some aspects, the present invention provides a bridge for a stringed instrument, having an elongate base piece with top, bottom, front, and rear surfaces. There is a vertical alignment hole at each end of the base piece formed from the top surface through the bottom surface. The bridge also includes a void near each vertical alignment hole in which is set a permanent magnet that magnetically attracts a bridge post made of one or more ferromagnetic materials situated within the vertical alignment hole to releasably retain the bridge connected to the bridge post.

In some aspects, the present invention also provides a tailpiece for a stringed instrument, having an elongate base piece with top, bottom, front, and rear surfaces. The base piece includes string holes in the base piece formed from the front surface through the rear surface. A vertical alignment slot is provided at each end of the base piece formed from the top surface through the bottom surface. Through each of the slots of the tailpiece is a horizontally aligned void within which is set a permanent magnet magnetically attracts a tailpiece post made of one or more ferromagnetic materials situated within the slot to releasably retain the tailpiece connected to the tailpiece post.

In some embodiments, the present invention provides a bridge for a stringed instrument comprising an elongate base piece with top and bottom surfaces, a vertical alignment hole at each end of the base piece, the vertical alignment hole being formed from the top surface through the bottom surface, and at least one magnetic means situated at a proximity to each vertical alignment hole sufficient to magnetically attract a ferromagnetic post located within the vertical alignment hole to releasably connect the bridge to the post.

In some embodiments, the present invention provides a tailpiece for a stringed instrument comprising an elongate base piece with top, bottom, front, and rear surfaces and having string holes being formed from the front surface through the rear surface, a vertical slot at each end of the base piece, the vertical slots being formed from the top surface through the bottom surface, and at least one magnetic means situated at a proximity to each slot sufficient to magnetically attract a ferromagnetic post located within the slot to releasably connect the tailpiece to the post.

In some embodiments, the magnetic means comprises a void provided in the base piece of the bridge or tailpiece, near the vertical alignment hole or slot, and a permanent magnet fixedly set into the void. Preferably, the permanent magnet is a rare earth magnet.

The invention further provides a method for mounting a bridge or a tailpiece to a stringed instrument comprising the steps of providing the bridge or tailpiece that comprises a base piece having vertical alignment holes or slots at each end of the base piece, providing magnetic means situated at a proximity to each vertical alignment hole or slot sufficient to magnetically attract a ferromagnetic post located within the vertical alignment hole or slot, mounting posts of a ferromagnetic material to the body of the stringed instrument, and placing the bridge or tailpiece on the posts such that the posts are inserted into vertical alignment holes or slots at each end of the base piece such that the magnetic means attracts the ferromagnetic posts to releasably connect the bridge or tailpiece to the post.

The components described herein are also designed to fit or retrofit most instruments without any modification to the original instrument. Even expensive "vintage" instruments can be fitted with the new components without any modification to the instrument, and the use of the new components does not detract from the "vintage" look of the instrument. The new components may be constructed to make visual detection of any difference between original stock components and the new components difficult. The new components are easy to use, install, and adjust by a purchaser. A professional installation and adjustment of the components is likely not needed after the first such installation and adjustment, as the instrument owner or user can perform the installation and maintenance.

Other aspects and features of the present invention will become apparent to those of ordinary skill in the art upon review of the following description of embodiments of the invention in conjunction with the accompanying figures and claims.

BRIEF DESCRIPTION OF THE DRAWINGS

In drawings which illustrate by way of example only embodiments of the invention.

DETAILED DESCRIPTION

Figure 1:
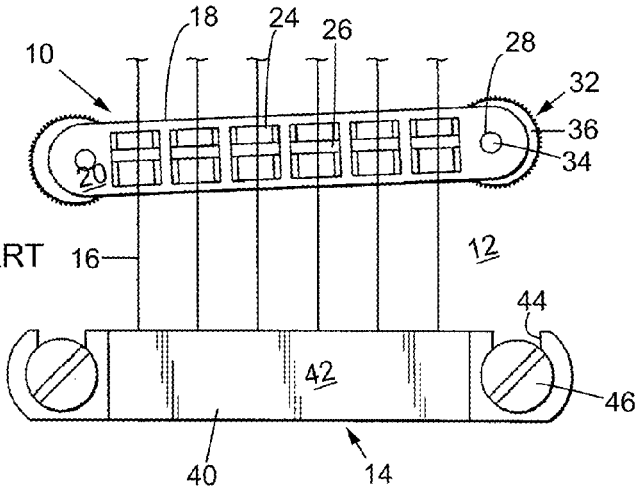
FIG. 1 PRIOR ART
FIG. 1 exemplary top view of a conventional Tune-o-matic style bridge and a tailpiece known in the prior art shown mounted in a body of a stringed instrument.
Figure 2:
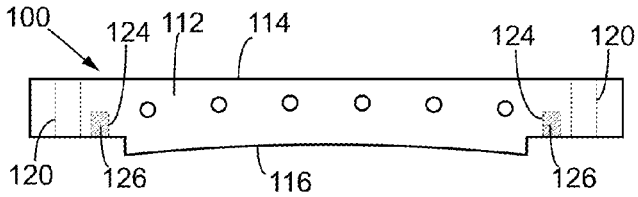
FIG. 2 an exemplary front, bottom and cross section view of a bridge according to an embodiment of the present invention.
Figure 2:
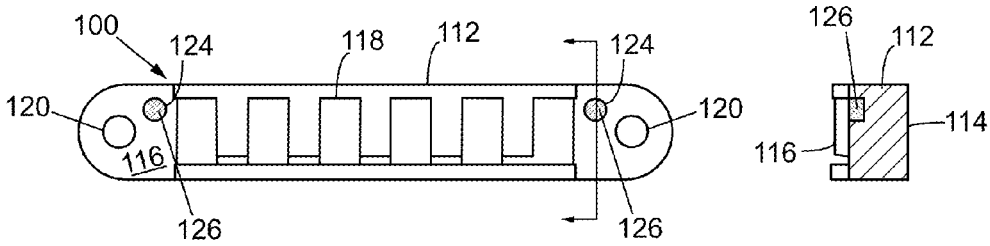

Referring now to FIG. 2, front, bottom and cross section views of an improved, exemplary guitar bridge 100 are shown. The guitar bridge 100 comprises an elongate base piece 112 that is typically formed of standard metal, such as steel or brass. A top surface 114 is generally flat, while a bottom surface 116 is generally concaved to match the curvature of a guitar. Alternatively, the top and bottom surfaces 114 and 116 may consist of other shapes. Cut or formed in the bridge 100 are several square or rectangular holes 118 extending from the top surface 114 through the bottom surface 116. It is within these rectangular holes 118 that the saddles for each string are mounted as is known in the art. Vertically through each end of the base piece 112 are vertical alignment holes 120 extending from the top surface 114 to the bottom surface 116. Also formed into the bottom surface 116 of base piece 112 at each end near each vertical alignment hole 120 are voids 124. Within each of the voids 124 is fixedly set a complementary shaped permanent magnet 126, preferably a compact high-strength magnet such as a rare earth magnet like samarium-cobalt and neodymium-iron-boron (NIB) magnets. The positioning and proximity of the voids 124, hence the magnets 126, relative to the vertical alignment holes 120 is such that the magnets 126 are able to magnetically attract a ferromagnetic post, such as a post member 34 comprising one or more ferromagnetic material (such as iron, nickel, cobalt and manganese, or their alloys) situated within the vertical alignment hole 120 to releasably retain the bridge on the post member 34. The voids 124 and the magnets 126 are examples of at least one magnetic means situated at a proximity to each vertical alignment hole sufficient to magnetically attract a ferromagnetic post located within the vertical alignment hole to releasably connect the bridge to the post.

In the illustrated embodiment of the guitar bridge 100, the voids 124 and the magnets 126 are shown as vertically aligned and partially extending from the bottom surface 116 towards the top surface 114. This location of the voids 124 and the magnets 126 preserves the aesthetics of the top surface 114 of the bridge and provides a relatively easy and economical way to manufacture the bridge as the voids 124 can be easily machined or molded into the base piece. However, other orientations, configurations, and positioning of the voids 124 and magnets 126 may be employed provided that such alternative orientations, configurations and positions of the magnets achieve a degree of magnetic attraction between the magnets in the bridge and a ferromagnetic post member of a bridge post sufficient to keep the bridge from falling off the bridge posts when the strings of the guitar are loosened or removed.

Figure 3:
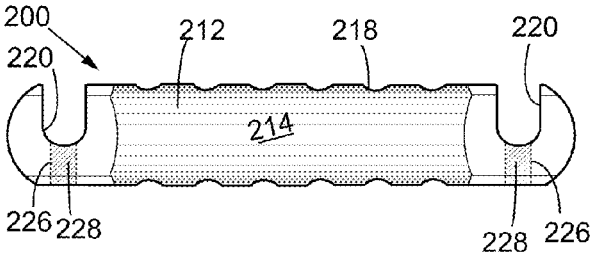
FIG. 3 an exemplary top and front view of a tailpiece according to an embodiment of the present invention.
Figure 3:
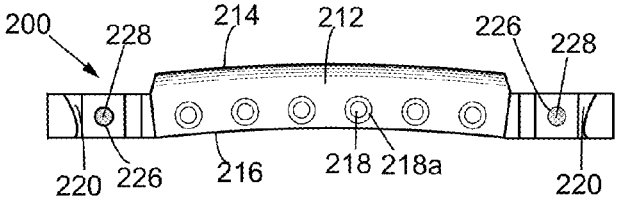

Referring now to FIG. 3, top and front views of an exemplary, new guitar tailpiece 200 are shown. The guitar tailpiece 200 comprises an elongate base piece 212 that is formed of standard metal, such as steel or brass. A top 214 and bottom 216 surfaces of the tailpiece 200 are generally curved in order to aesthetically match the surface curve of a guitar upon which the tailpiece 200 is to be mounted. Several longitudinal string holes 218, generally evenly spaced apart along the width of the tailpiece 200, are formed or machined through the tailpiece 200. These string holes 218 also have chamfered edges or indentations 218*a* of a slightly larger diameter on both the front and rear entries of the string holes 218 to accommodate small balls which are manufactured at the ends of steel strings used in some guitars. The strings are placed through the string holes 218 towards the bridge 100 (FIG. 2) and nut of the guitar, not shown. It is these balls on the ends of the strings which absorb all of the tension on the strings after top ends of the strings are mounted on tuning screws on a neck of the guitar.

Vertical slots 220 are formed on each end of the tailpiece 200. These slots 220 are typically rounded and extend from the top surface 214 through the bottom surface 216, and accommodate adjustment studs or tailpiece posts 46 upon which the tailpiece 200 is mounted. Alternatively, the slots 220 may comprise openings through a side of the tailpiece 200.

Through each of the slots 220 of the tailpiece 200 are horizontally aligned voids 226 within which is fixedly set a complementary shaped permanent magnet 228, preferably a compact high-strength magnet such as a rare earth magnet like samarium-cobalt and neodymium-iron-boron (NIB) magnets. The positioning and proximity of the voids 226, hence the magnets 228, relative to the slots 220 is such that the magnets 228 are able to magnetically attract an adjustment studs such as tailpiece post 46 comprising one or more ferromagnetic material (such as iron, nickel, cobalt and manganese, or their alloys) situated within the slots 220 to releasably retain the tailpiece 200 connected to the tailpiece posts 46. The voids 226 and the magnets 228 are examples of at least one magnetic means situated at a proximity to each slot sufficient to magnetically attract a ferromagnetic post located within the slot to releasably connect the tailpiece to the post.

In the illustrated embodiment of the tailpiece 200, the voids 226 and the magnets 228 are shown as horizontally aligned and through the material at the base of the slots 220. This location of the voids 226 and the magnets 228 preserves the aesthetics of the top surface 214 of the tailpiece and provides a relatively easy and economical way to manufacture the tailpiece as the voids 226 can be easily machined or molded into the tailpiece. However, other orientations, configurations, and positioning of the voids 226 and magnets 228 may be employed provided that such alternative orientations, configurations and positions of the magnets achieve a degree of magnetic attraction between the magnets in the tailpiece and a ferromagnetic adjustment stud sufficient to keep the tailpiece from falling off the adjustment studs when the strings of the guitar are loosened or removed.

While the above description and illustrations constitute preferred or alternate embodiments of the present invention, it will be appreciated that numerous variations may be made without departing from the scope of the invention. Thus, the embodiments described and illustrated herein should not be considered to limit the invention as construed in accordance with the accompanying claims.

The invention claimed is:

1. A bridge for mounting on spaced apart ferromagnetic posts on a stringed instrument, the bridge comprising: an elongate base piece with top and bottom surfaces; a vertical alignment hole at each end of the base piece, the vertical alignment holes being formed from the top surface through the bottom surface and adapted to simultaneously receive the spaced apart ferromagnetic posts; and at least one magnetic means situated at a proximity to each vertical alignment hole sufficient to magnetically attract the ferromagnetic post located within the vertical alignment hole to releasably connect the bridge to the ferromagnetic posts, and thereby to releasably connect the bridge to the stringed instrument.

2. The device of claim 1 wherein the magnetic means comprises a void provided in the base piece near the vertical alignment hole and a permanent magnet fixedly set into the void.

3. The device of claim 2 wherein the permanent magnet is a rare earth magnet.

4. A tailpiece for mounting on spaced apart ferromagnetic posts on a stringed instrument, the tailpiece comprising: an elongate base piece with top, bottom, front, and rear surfaces and having string holes being formed from the front surface through the rear surface; a vertical slot at each end of the base piece, the vertical slots being formed from the top surface through the bottom surface and adapted to simultaneously receive the spaced apart ferromagnetic posts; and at least one magnetic means situated at a proximity to each slot sufficient to magnetically attract the ferromagnetic post located within the slot to releasably connect the tailpiece to the ferromagnetic posts, and thereby to releasably connect the tailpiece to the stringed instrument.

5. The device of claim 4 wherein the magnetic means comprises a void provided in the base piece near the slot and a permanent magnet fixedly set into the void.

6. The device of claim 5 wherein the permanent magnet is a rare earth magnet.

7. A method for mounting a bridge or a tailpiece to a body of a stringed instrument comprising the steps of:

providing the bridge or tailpiece comprising a base piece having vertical alignment holes or slots at each end of the base piece;

providing magnetic means situated at a proximity to each vertical alignment hole or slot sufficient to magnetically attract a ferromagnetic post located within the vertical alignment hole or slot;

providing mounting posts of a ferromagnetic material to the body of the stringed instrument at a distance from each other that corresponds to the distance between the vertical alignment holes or slots; and placing the bridge or tailpiece on the posts such that the posts are inserted into vertical alignment holes or slots at each end of the base piece such that the magnetic means attracts the ferromagnetic posts to releasably connect the bridge or tailpiece to the posts, and thereby to releasably connect the bridge or tailpiece to the stringed instrument.

8. The method of claim 7 wherein the magnetic means comprises a void provided in the base piece near the vertical alignment hole or slot and a permanent magnet fixedly set into the void.

9. The method of claim 8 wherein the permanent magnet is a rare earth magnet.

* * * * *